US006935064B1

(12) United States Patent
Thompson

(10) Patent No.: US 6,935,064 B1
(45) Date of Patent: Aug. 30, 2005

(54) RECEIVER MOUNTED SHOOTING REST

(76) Inventor: Douglas E. Thompson, 8376 Byrnesville Rd., House Springs, MO (US) 63051

( * ) Notice: Subject to any disclaimer, the term of this patent is extended or adjusted under 35 U.S.C. 154(b) by 0 days.

(21) Appl. No.: 10/822,936

(22) Filed: Apr. 13, 2004

(51) Int. Cl.[7] ..... F41A 29/00

(52) U.S. Cl. ..... 42/94; 248/370; 248/371; 248/176.1

(58) Field of Search ..... 42/94; 246/370, 246/371, 398, 157, 176.1

(56) References Cited

U.S. PATENT DOCUMENTS

| | | | | | |
|---|---|---|---|---|---|
| 203,184 | A | | 4/1878 | Muller | 42/94 |
| 4,937,965 | A | | 7/1990 | Narvaez | 42/94 |
| 5,060,410 | A | * | 10/1991 | Mueller | 42/94 |
| 5,149,900 | A | * | 9/1992 | Buck | 42/94 |
| 5,397,147 | A | | 3/1995 | Ducharme et al. | 280/415.1 |
| 5,491,921 | A | | 2/1996 | Allen | 42/94 |
| 5,664,717 | A | | 9/1997 | Joder | 224/502 |
| 5,755,411 | A | | 5/1998 | Strong, III et al. | 248/118 |
| 5,833,308 | A | | 11/1998 | Strong, III et al. | 297/172 |
| 5,857,741 | A | | 1/1999 | Anderson | 297/170 |
| 5,884,966 | A | * | 3/1999 | Hill et al. | 297/170 |
| 5,933,999 | A | | 8/1999 | McClure et al. | 42/94 |
| 5,979,099 | A | | 11/1999 | Kervin | 42/94 |
| 6,058,641 | A | | 5/2000 | Vecqueray | 42/94 |
| 6,269,578 | B1 | | 8/2001 | Callegari | 42/94 |
| 6,338,218 | B1 | | 1/2002 | Hegler | 42/94 |
| 2002/0008364 | A1 | | 1/2002 | Kahlstorf | 280/515 |
| 2003/0168487 | A1 | | 9/2003 | Lane et al. | 224/499 |

* cited by examiner

*Primary Examiner*—J. Woodrow Eldred
(74) *Attorney, Agent, or Firm*—Grace J. Fishel

(57) ABSTRACT

The invention disclosed is a device for use as a shooting platform. The shooting platform may be attached to a receiver hitch on a vehicle and may be collapsed against the vehicle for storing and for transportation on the vehicle. The shooting platform may be adaptable for right and left handed shooters. The device may include a seat for the user. The platform and the seat may have height adjustments to fit the preferences of a user and may also have adjustments to permit the leveling and/or the preferences of a user for angular positioning.

22 Claims, 5 Drawing Sheets

RECEIVER MOUNTED SHOOTING REST

BACKGROUND OF THE INVENTION

1. Field of the Invention

The present invention relates to a receiver mounted shooting rest for use on a vehicle.

2. Brief Description of the Prior Art

Portable shooting rests are particularly designed for field varmint shooting. Since a shooter and a varmint are frequently separated by several hundred yards and the varmints are small, the rifle must be supported for accurate shooting. However, since the varmints may also be very mobile, the shooter must be able to assume a stable shooting position with the gun supported quickly.

The following U.S. patents and published applications are incorporated by reference herein: U.S. Pat. No. 203,184, 4,937,965, 5,397,147, 5,491,921, 5,664,717, 5,755,411, 5,833,308, 5,857,741, 5,933,999, 5,979,099, 6,058,641, 6,269,578, 6,338,218, 2002/0008364 and 2003/0168487.

BRIEF SUMMARY OF THE INVENTION

The device of the present invention is a shooting support for a firearm. In particular, a device of the present invention is a shooting support which may be attached to a vehicle and may be transported and stored while attached to a vehicle if preferred by a user. In an embodiment of the invention the shooting support may be collapsed against the vehicle. The device of the invention may be used in a number of firing positions and is adjustable for length, height and level or other angular orientations, including left/right orientations, as preferred by the user. The components of the device may be assembled to fit both left handed and right handed users, as described herein.

The device of the invention may have a firearm supporting platform which may be used to support a firearm. The firearm supporting platform may cooperate with additional supporting elements and structures, such as sandbags and/or conventional firearm leveling supports, and similar devices.

It is thus an object of this invention to provide a receiver mounted shooting support for use on vehicle which may be assembled to fit both left handed and right handed users. It is another object to provide a shooting support which can be transported and/or stored in a configuration attached to a vehicle. It is a further object to provide a shooting support which may be adjusted to fit the size and/or spacial preferences of the user.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
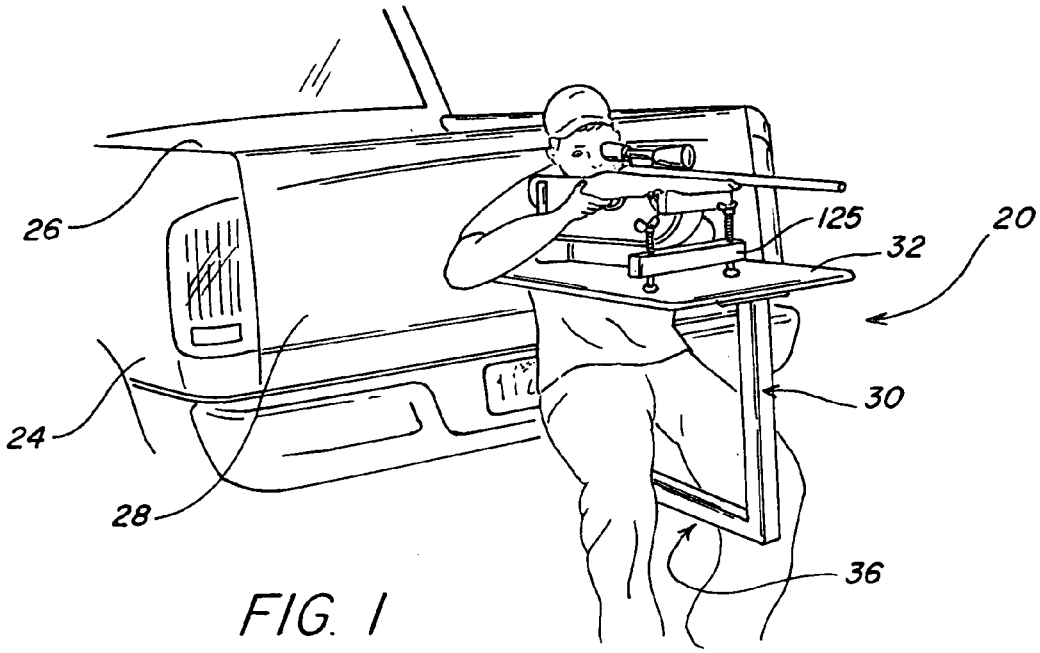
FIG. 1 is a right perspective view of a device of the invention mounted on a vehicle.
Figure 2:
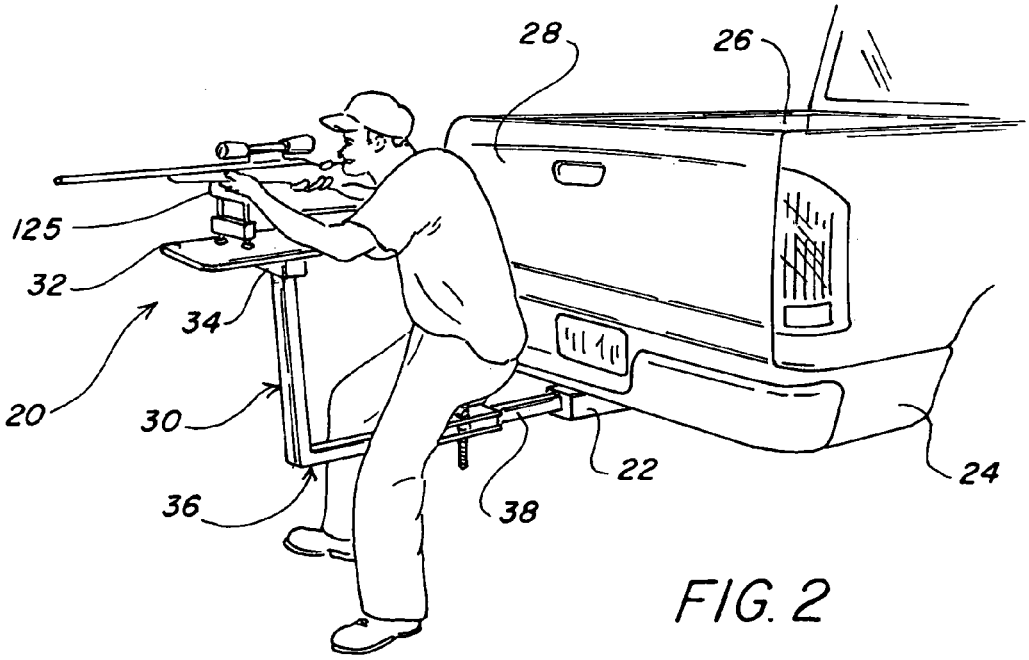
FIG. 2 is a left perspective view of the device of the invention mounted on a vehicle.

Referring to FIGS. 1 and 2, a shooting support 20 is shown mounted to a receiver hitch, such as a Reese receiver 22, of a vehicle 24. Vehicle 24 may have a bed 26 and a tailgate 28, as shown, or may be another type of vehicle such as a van, four wheeler and the like. As shown, device 20 has a vertical supporting element 30 which supports a platform 32 on a horizontal supporting element 34. Device 20 also has a horizontal mounting element 36. Elements 30, 34 and 36 make up a frame. Horizontal mounting element 36 includes a joining member 38. Joining member 38 may be attached to a vehicle trailer hitch such as receiver 22, as shown. Horizontal mounting element 36 and joining member 38 may be unitary or may be formed of a plurality of sub-elements, as described further herein.

Figure 3:
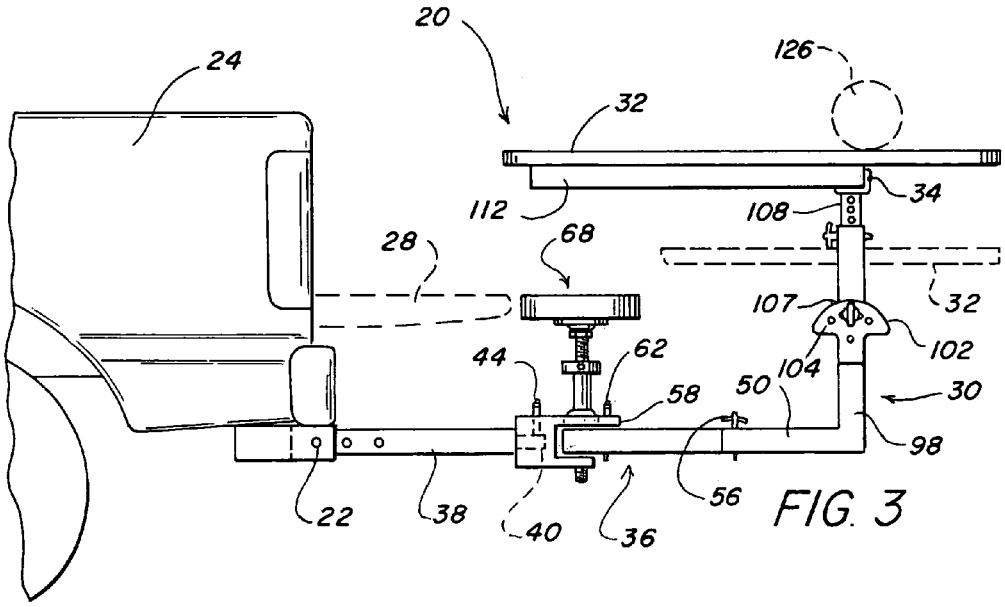
FIG. 3 is a right side view of the device of the invention.
Figure 6:
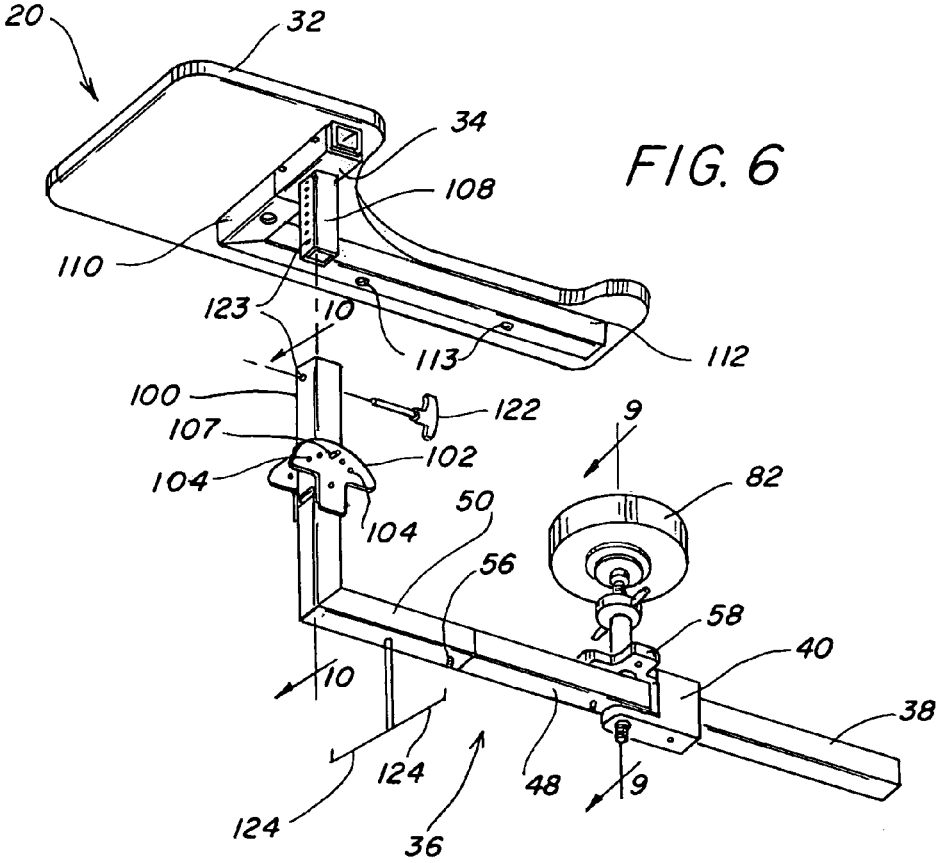
FIG. 6 is a partial exploded view of the device of the invention.
Figure 7:
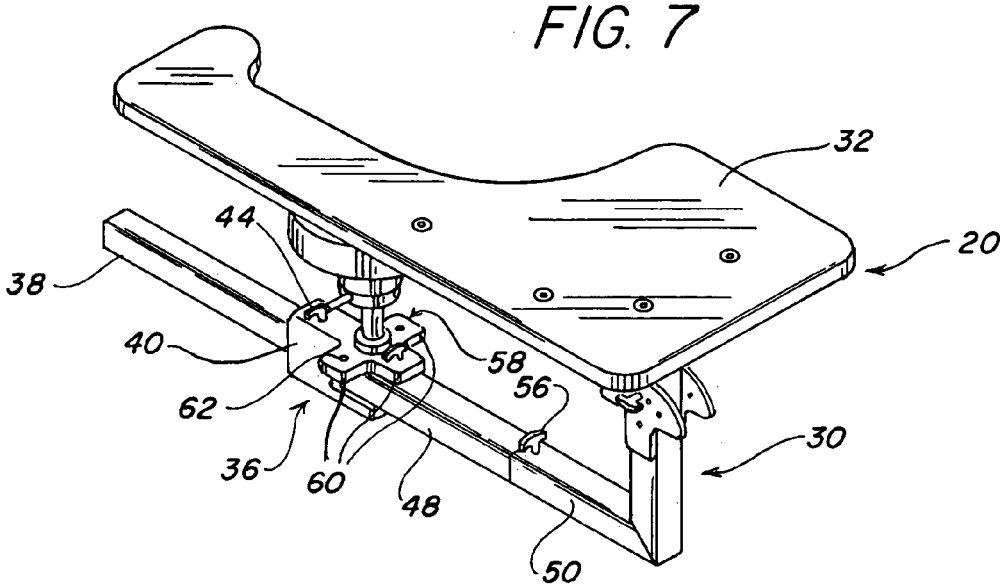
FIG. 7 is a perspective view of the device of the invention shown in FIG. 3.
Figure 8:
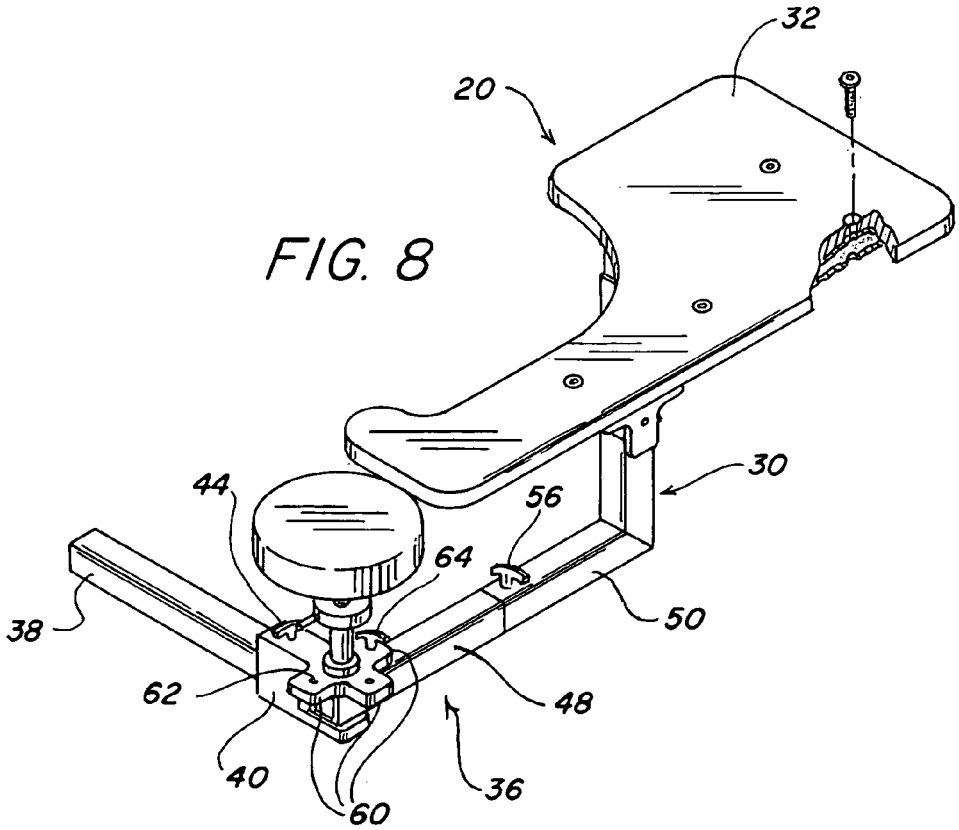
FIG. 8 is a further perspective view of the device of the invention shown in FIG. 4, partially broken away to show a recessed fastener for mounting the platform to the platform support.

Referring to FIGS. 3, 4, and 6 through 8, horizontal mounting element 36 and joining member 38 are shown as formed of a plurality of sub-elements. Joining member 38 has a yoke 40 at its proximal end. Yoke 40 may be unitary with joining member 38 or it may be a separate sub-element, as shown. The separate sub-element yoke 40 may be attached to the proximal end of joining member 38 by a pin 44, or another fastener such as a bolt or screw, as shown in FIGS. 3, 7 and 8. Yoke 40 may be bifurcated, as shown, to receive the distal end of a sub-element 48 (FIG. 6).

Sub-element 48 may attach to vertical supporting member 30 as a unitary piece or it may have an additional sub-element 50, as shown, or additional sub-elements as shown in FIGS. 6–8. The proximal end of sub-element 48 may be removably connected to the distal end of sub-element 50 by a pin connector 56 or by an equivalent fastener such as a bolt or a screw, as known in the art. It will be appreciated that this connection may also be adjustable, for example by telescoping pin and bore connections, as disclosed for the other elements and sub-elements of shooting support 20.

As shown in the drawings, upper flange 58 (FIGS. 6–7) of yoke 40 may have a plurality of lobes 60 (FIGS. 7–8) which are spaced to allow sub-element 48 to be attached to yoke 40 in several configurations. For example, shooting support 20 may be collapsed to the right or to the left to save space during storage or transportation of shooting support 20. Each of the lobes 60 may be equipped with pin bores 62 to receive a pin connector 64 which cooperates with a bore 66 (FIG. 9) on the distal end of sub-element 48 to fix shooting support 20 in the selected position.

Figure 4:
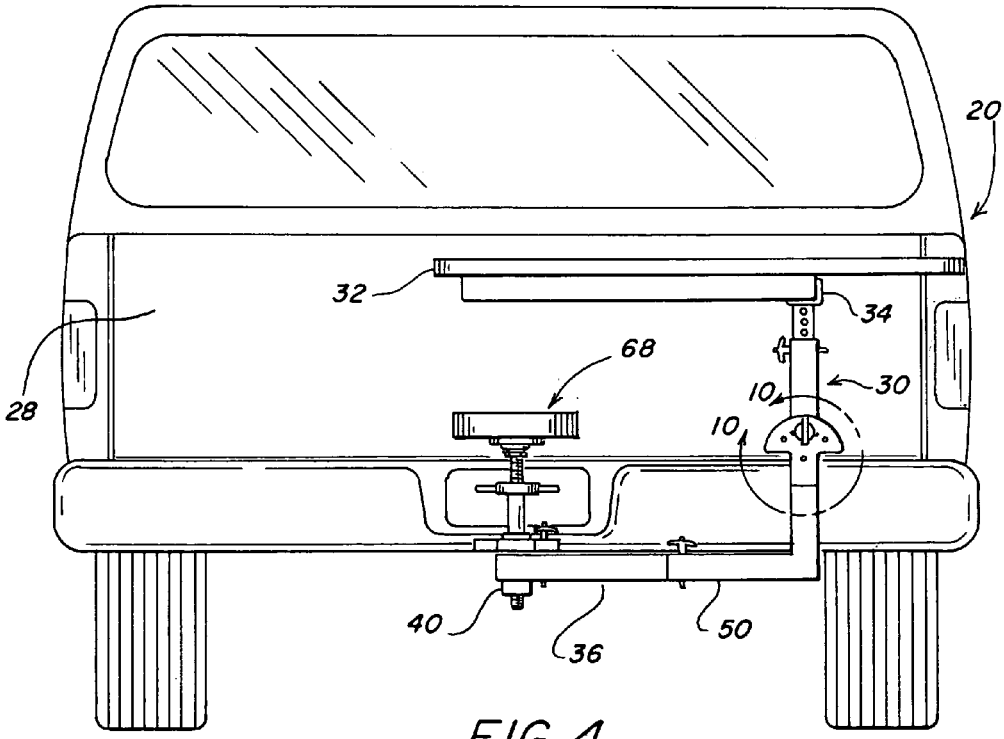
FIG. 4 is a front view of the device shown in FIG. 3.
Figure 9:
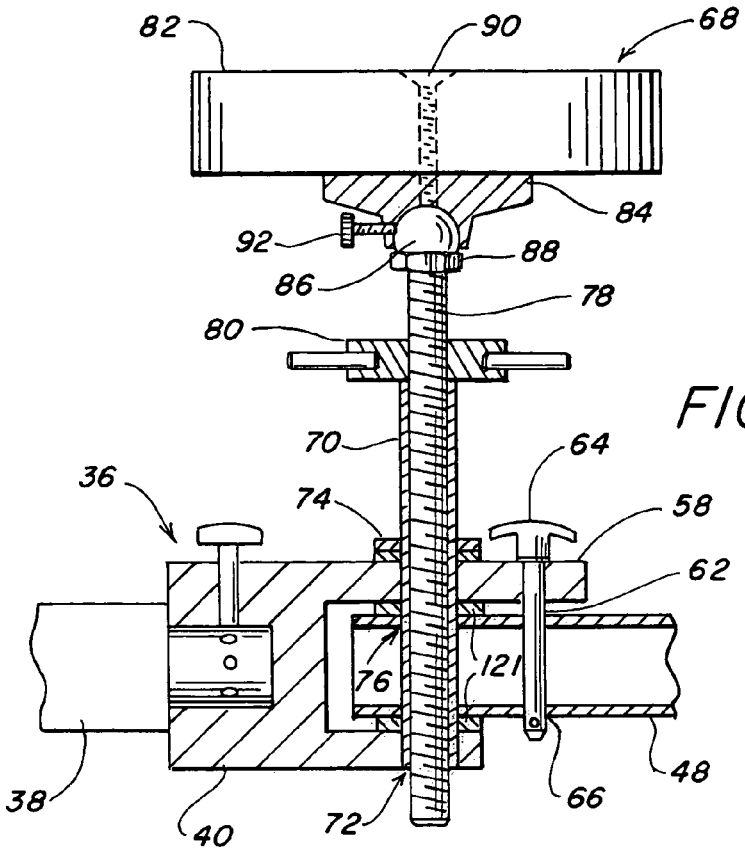
FIG. 9 is a partial cross-sectional view of the device of the invention taken along the plane 9—9 in FIG. 6; and, FIG. 10 is a detail on an enlarged scale taken along line 10—10 in FIG. 4.

Referring to FIGS. 3, 4 and 9, device 20 may also be provided with a seat support 68. As shown, seat support 68 is mounted through yoke 40. A seat support tube 70 may be removably installed in bores 72 through yoke 40. Seat support tube 70 may be held in position by a stop 74 attached to seat support tube 70. Stop 74 cooperates with yoke 40 to position seat support tube 70. The distal end of sub-element 48 may have a bore 76 through which seat support tube 70 passes and which permits sub-element 48 to pivot around seat support tube 70 serving as a hinge. Pin connector 64 with bore 66 acts as a latch to fix the hinge in a plurality of angular positions. Seat support tube 70 may receive a threaded support rod 78, as shown. Threaded support rod 78 may have a wing nut 80 threaded thereon; wing nut 80 and threaded support rod 78 cooperate to provide height adjustment of seat support 68, as described herein.

Seat support 68 has a seating platform 82 which may be mounted on a boss 84, as shown. Boss 84 is connected to threaded support rod 78. If desired, boss 84 may have a ball pivot connection 86 to threaded support rod 78 which permits angular adjustment of seating platform 82. A jam nut 88 may be used to lock the position of seating platform 82. In addition, if desired, seating platform 82 may have an additional fixture or fixtures 90 or 92 to fasten the position of seating platform 82. Fixtures 90 and 92 may be conventional set screws, as is known in the art.

With continuing reference to FIG. 9, it is seen that proximal end of joining member 38 terminates with a cylinder 94 having a plurality of holes 96 about the circumference thereof for receipt of pin 44. Pin 44 and holes 96 provide for angular adjustment of horizontal mounting element 36 with respect to joining member 38.

Figure 10:
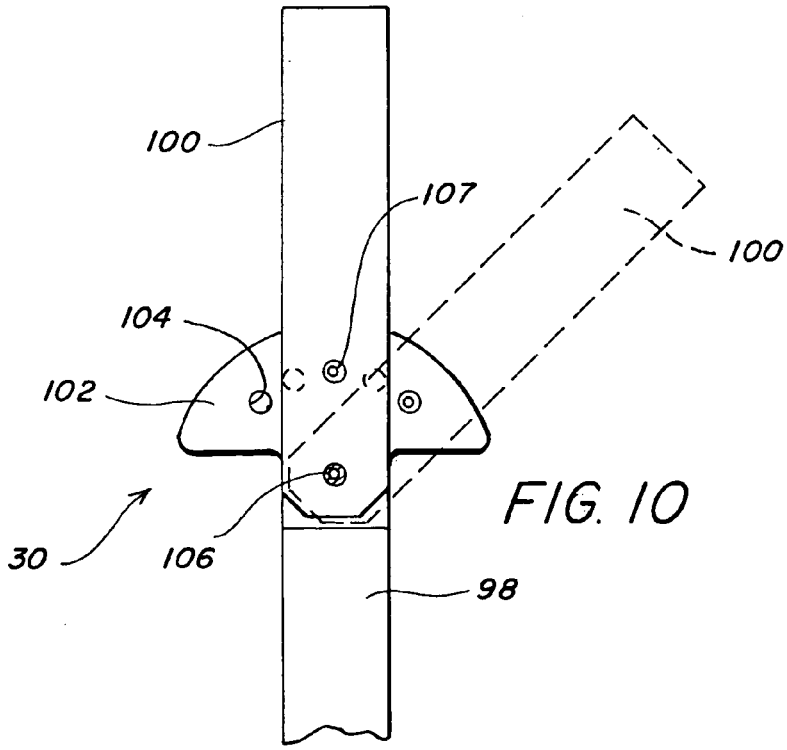

As shown in FIG. 10, the position of platform 32 is also adjustable. Vertical supporting element 30 may be formed of several sub-elements. A lower sub-element 98 may be attached to horizontal sub-element 50, for example by welding or by the use of conventional fasteners. An intermediate sub-element 100 may be attached to lower sub-element 98 by a yoke 102, as shown. Yoke 102 adjustably receives intermediate sub-element 100 by use of a plurality of angularly distributed bores 104 which cooperate to fix the position of intermediate sub-element 100 around pivot 106 by use of fasteners 107, as shown and as known in the art.

Intermediate sub-element 100 may receive an upper sub-element 108 (FIG. 6) which may telescope into intermediate sub-element 100 and be adjustably fixed in place by bores and fasteners as previously described. Upper sub-element 108 is attached to horizontal supporting element 34, as shown. Horizontal supporting element 34 adjustably receives transverse platform support 110. Transverse platform support 110 is attached to longitudinal platform support 112, as shown. Platform 32 is removably attached to transverse platform support 110 and longitudinal platform support 112 by conventional fasteners 113 the heads of which may be recessed as shown in FIG. 8.

It will be appreciated by those skilled in the art that shooting support 20 may be constructed of a variety of conventional structures and materials. For example, the bulk of shooting support 20 is shown as constructed of conventional square tubing, which may be of steel, aluminum or other materials. However, shooting support 20 could use rectangular, circular, triangular or other tubing. In addition, other forms, such as channel, angle or I forms could also be used. In some of the embodiments shown, various elements and sub-elements are telescoped together. The telescoped component elements may be fixed by pin and bore connections, as shown. The pins may use spring and ball detents, also as shown. In addition, other fasteners may be used, including bolt and nut fasteners, machine screws or other equivalent fasteners. Various components may also be joined by welding, brazing and the like as known in the art.

Operation of the Device

As shown in FIGS. 1 and 2, shooting support 20 may be attached to a vehicle 24 by inserting the distal end of joining member 38 in receiver 22, or an equivalent structure, and fastening the connection with a pin and bore fastener at a length adjustment preferred by the user. The user adjusts the height of seating platform 82 by threading wing nut 80 around threaded support rod 78 lifting threaded support rod 78 out of seat support tube 70. It will be appreciated that seat support tube 70 may be threaded internally if desired. The connection between seat support tube 70 and threaded support rod 78 may be made tighter by inserting grommets, O-rings and other shimming structures into seat support tube 70 to provide a snug fit. Yoke 40 may also be shimmed at 121 to provide a snug fit with horizontal mounting element 36, as shown in FIG. 9. Seating platform 82 may be leveled, or other orientation selected, by use of ball pivot connection 86 and the orientation of seating platform 82 may be fixed by use of jam nut 88 and/or either of set screws 90 and 92.

Figure 5:
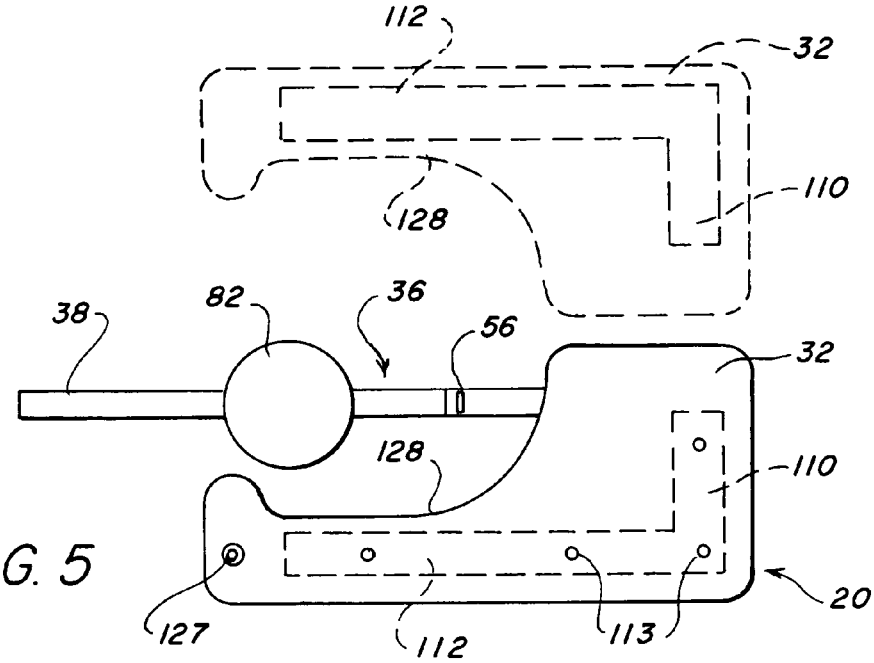
FIG. 5 is a top plan view of the device of the invention shown in full lines for right-handed use and in broken lines for left-handed use.

The height of platform 32 may be adjusted by telescoping upper and intermediate sub-elements 108 and 100 with a pin 122 and a bore 123 connection shown in FIG. 6. In addition, the angular orientation of platform 32 may be adjusted by use of yoke 102 shown in FIGS. 3, 6 and 10 acting as a hinge and with pin 107 and bores 104 serving as a latch. Further angular adjustment of platform 32 may be obtained by setting the angular relationship of horizontal mounting element 36 with respect to joining member 38 with pin 44 in selected hole 96 of cylinder 94. A bubble level 127 may be provided as shown in FIG. 5 for positioning platform 32 as desired. The angular orientation, left and right, of platform 32 may be adjusted by use of yoke 40 and pin 64 and bore 62 connection shown in FIGS. 7, 8 and 9.

When the elements of shooting support 20 are adjusted to the user's preference, the user sits on seating platform 82. The user's feet may rest on the ground or may be placed on foot rests, such as elements 124 shown in FIG. 6. The user's firearm may be rested on a leveling support 125 (FIGS. 1–2), which may be conventional, or the user may use a sandbag 126 (FIG. 3) or similar device as is known in the art. In addition, shooting support 20 may be used in the prone or reverse prone position by lowering platform 32 and extending tailgate 28 of a suitable vehicle, as shown in phantom in FIG. 3.

It will be appreciated that platform 32 may be reversible to fit both right handed and left handed users. As shown in solid lines in FIG. 5 platform 32 is mounted for a right handed user with cutout 128 on the right. However, platform 32 is removably connected to transverse platform support 110 and longitudinal platform support 112 by suitable fasteners 113, such as those described herein. Transverse platform support 110 is also removably connected, and may be adjustably connected, to horizontal supporting element 34 by similar suitable fasteners. Horizontal supporting element 34 is shown as a channel form (FIG. 6), but it will be appreciated that a tube, a plate, angles or other forms may be used. When platform 32 connections and supporting element 34 connections are disconnected platform 32 and longitudinal platform support 112/transverse platform support 110 may each be rotated one hundred eighty degrees, as shown in phantom in FIG. 5. Elements may be reattached in this configuration to fit a left handed user.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A device for supporting a firearm comprising a frame and a platform mounted on the frame, the frame having a vertical support and a horizontal support, the horizontal support being connected at a first end to the vertical support and being connectable at a second end to a vehicle hitch, the device having a seating support at an intermediate location on the horizontal support, the device having a hinge at an intermediate location on the horizontal support, the hinge permitting rotation of the horizontal support to the right and left into positions perpendicular to the vehicle hitch and having a latch to fix the hinge in a plurality of angular positions, said seating support having a vertical member forming a pivot point of the hinge, the platform being mounted at an upper position of the vertical support to provide a rest for a firearm.

2. The device of claim 1 wherein the seating support is vertically adjustable.

3. The device of claim 1 wherein the vertical member is a tube.

4. The device of claim 3 wherein the seating support has a seating platform and wherein the seating platform is mounted on a vertical support member, the vertical support member being received in the tube and cooperating therewith to provide vertical adjustment of the seating support.

5. The device of claim 1 wherein the horizontal support includes a length adjustment which may be connected to a vehicle.

6. The device of claim 5 wherein the length adjustment includes a plurality of pin and bore connections at the second end of the horizontal support.

7. The device of claim 1 wherein the seating platform includes an angular adjustment.

8. The device of claim 7 wherein the angular adjustment includes a ball pivot located on the seating platform, the ball pivot being connected to the vertical support member and cooperating therewith to adjust the angular orientation of the seating platform in relation to the horizontal plane.

9. The device of claim 8 wherein the angular adjustment includes a lock to fix the angular position of the seating platform.

10. The device of claim 1 wherein the device has an angular adjustment for the platform.

11. The device of claim 10 wherein the platform angular adjustment includes a hinge on the vertical support.

12. The device of claim 11 wherein the vertical support hinge includes a latch to fix the angular orientation of the platform in relation to the horizontal plane.

13. The device of claim 1 wherein the device has a vertical adjustment for the platform.

14. The device of claim 13 wherein the platform vertical adjustment includes a plurality of telescoping sections with pin and bore connections.

15. A device for supporting a firearm comprising a frame and a platform mounted on the frame, the frame having a vertical support and a horizontal support, the horizontal support being connected at a first end to the vertical support and being connectable at a second end to a vehicle hitch, the device having a platform mounted on an upper end of the vertical support, the platform having an upper firearm supporting surface thereon, the device having a hinge at an intermediate location of the horizontal support, the hinge including a yoke, the yoke having a pivoting connection with the horizontal support permitting rotation of the horizontal support to the right or left into positions perpendicular to the vehicle hitch, the device having a seating support mounted on the yoke, the seating support having a vertical tube mounted through the yoke at the pivoting connection with the horizontal support, the seating support including a seating platform mounted on a vertical support member, the vertical support member being adjustably received in the vertical tube.

16. The device of claim 15 wherein the vertical support is threaded and an adjusting nut is mounted on the vertical support, the adjusting nut providing vertical adjustment for the seating platform.

17. The device of claim 15 wherein the device has an angular adjustment on the horizontal support, the angular adjustment including a plurality of pin and bore connectors on the yoke, the pin and bore connectors cooperating with a pin and bore connector on a portion of the horizontal support to position a portion of the horizontal support at a plurality of angles in the horizontal plane.

18. The device of claim 15 wherein the platform is removably and selectively mountable for left handed and right handed users.

19. A shooting support for a firearm comprising a frame and means for mounting a platform on the frame, the frame having a vertical support and a horizontal support, the horizontal support having means for connecting a first end to the vertical support and having means for connecting a second end to a vehicle hitch, a means for mounting a seating support at an intermediate location on the horizontal support, the means for mounting the seating support having means for angular adjustment of a portion of the horizontal support in the horizontal plane to the right or left into positions perpendicular to the vehicle hitch and having means to selectively fix the angular adjustment at a plurality of angular positions.

20. The device of claim 1 wherein the hinge includes a yoke and the yoke is pivotable about a long axis of the horizontal support and includes a latch to fix the yoke in a plurality of rotated positions.

21. The device of claim 15 wherein the yoke is pivotable about a long axis of the horizontal support and includes a latch to fix the yoke in a plurality of rotated positions.

22. The shooting support of claim 19 further comprising means for rotational adjustment of a portion of the horizontal support about a long axis of the horizontal support and having means to selectively fix the rotational adjustment at a plurality of rotated positions.

* * * * *